US005925601A

United States Patent [19]

McSherry et al.

[11] Patent Number: 5,925,601

[45] Date of Patent: Jul. 20, 1999

[54] FATTY AMIDE ETHOXYLATE PHOSPHATE ESTER CONVEYOR LUBRICANT

[75] Inventors: David Daniel McSherry, Minneapolis; Guang-jong Jason Wei, Mendota Heights, both of Minn.

[73] Assignee: Ecolab Inc., St. Paul, Minn.

[21] Appl. No.: 09/170,317

[22] Filed: Oct. 13, 1998

Related U.S. Application Data

[51] Int. Cl.[6] ..... C10M 137/06; C10M 173/02; C10M 137/08

[52] U.S. Cl. ..... 508/425; 508/428

[58] Field of Search ..... 508/425, 428

[56] References Cited

U.S. PATENT DOCUMENTS

| | | | |
|---|---|---|---|
| 2,862,882 | 12/1958 | Hotten et al. | 508/428 |
| 3,309,352 | 3/1967 | Young et al. . | |
| 3,860,521 | 1/1975 | Aepli et al. . | |
| 4,220,611 | 9/1980 | Wolf . | |
| 4,521,321 | 6/1985 | Anderson et al. . | |
| 4,604,220 | 8/1986 | Stanton . | |
| 4,670,169 | 6/1987 | Adams et al. | 508/428 |
| 4,770,801 | 9/1988 | Adams et al. | 508/428 |
| 4,929,375 | 5/1990 | Rossio et al. . | |
| 4,938,884 | 7/1990 | Adams et al. | 508/428 |
| 5,001,114 | 3/1991 | McDaniel, Jr. . | |
| 5,062,979 | 11/1991 | Scharf et al. . | |
| 5,080,814 | 1/1992 | Awad . | |
| 5,174,914 | 12/1992 | Gutzmann . | |
| 5,223,162 | 6/1993 | Rossio . | |
| 5,352,376 | 10/1994 | Gutzmann . | |
| 5,389,199 | 2/1995 | Awad et al. . | |
| 5,391,308 | 2/1995 | Despo . | |

FOREIGN PATENT DOCUMENTS

| | | |
|---|---|---|
| 0 293 820 | 12/1988 | European Pat. Off. . |
| 7-179887 | 7/1995 | Japan . |
| 7-194959 | 8/1995 | Japan . |
| WO 96/02616 | 2/1996 | WIPO . |

OTHER PUBLICATIONS

"Lubricants and Lubricant Additives: II. Performance Characteristics of Some Substituted Fatty Acid Esters," *Journal of the American Oil Chemists' Society*, vol. 52, No. 12, (Dec. 1975) pp. 494–497.

*Primary Examiner*—Jerry D. Johnson
*Attorney, Agent, or Firm*—Merchant, Gould, Smith, Edell, Welter & Schmidt, P.A.

[57] ABSTRACT

A method of lubricating conveyors with a lubricating concentrate formulated to contain about 0.5 wt-% to 90 wt-% of a fatty amide ethoxylate phosphate ester diluted to a use solution formulated to contain about 5 ppm to 1000 ppm of a fatty amide ethoxylate phosphate ester is described. The use solution is applied to an intended surface for lubrication. The lubricant can contain a variety of other chemical agents to provide additional desired properties including surfactants, chelating agents, sanitizing agents, and others. The lubricant concentrate or use solution is especially useful on conveyor systems with moving beverage containers such as glass, metal or plastic containers.

19 Claims, No Drawings

FATTY AMIDE ETHOXYLATE PHOSPHATE ESTER CONVEYOR LUBRICANT

FIELD OF THE INVENTION

The invention relates generally to methods and compositions for lubricating conveyors. More specifically, the invention relates to methods and compositions which lubricate conveyors moving containers such as glass, metal or plastic containers. The method especially applies to the beverage market where typical lubricants form precipitates when in contact with beverage solutions.

BACKGROUND OF THE INVENTION

Aqueous lubricant compositions have been known for many years and have been applied to a variety of technologies including metal cutting and forming, the lubrication of oil drilling equipment, etc. One important application is the lubrication of the interface between a container and a moving conveyor line or track surface. Many common conveyor lubricants are based on fatty acid formulations. Such fatty acids are natural products comprising commercially available cocoa or tallow acids. The use of alkyl amines, phosphate esters, α-olefin sulfonates and amphoteric materials such as imidazolines and amino carboxylic acids in formulated lubricants have also been attempted.

As is known to those skilled in the art to which the present invention pertains, there has been an increasing usage of P.E.T. containers for beverages and other foodstuffs. Such containers are normally filled by passing them through filling and capping stations controlled by conveyor systems.

To ensure proper operation of the filling and capping systems, it is vital that the conveyor systems be continuously lubricated. Without adequate lubrication, the containers may stack up along the conveyor system, impeding their movement.

Thus, the conveyors are continuously lubricated by applying a lubricant to the conveyor, such as by spraying or the like. Conventional lubricants contain fatty acids, nonionic surfactants, alcohols, potassium hydroxide and other constituents, which in various combinations have functional disadvantages. For example, fatty acid lubricants form insoluble calcium salts when diluted with hard service water. Conventional lubricants are often incompatible with plastic, e.g. P.E.T. containers disposed along the conveyor system, causing them to eventually crack in transit or storage. Indeed, it has long been known that exposure by such P.E.T. containers to incompatible lubricants leads to a phenomenon which has been identified as "stress crack failure."

The lubricants commonly used on the load-bearing surfaces of these conveyor systems, such as those used in the food processing, beverage and brewery industries, typically contain fatty acid soaps as the active lubricating ingredient, because of the superior lubricity provided by fatty acid soaps.

The fatty acid soaps are generally formed by neutralizing a fatty acid with a caustic compound such as alkali metal hydroxide (NaOH or KOH) or an alkanolamine (MEA, DEA or TEA) and have an alkaline pH. Fatty acid soaps neutralized with such caustic compounds are generally incompatible with polyethylene terephthalate to such an extent that prolonged contact frequently results in the formation of stress cracks and fissures in the plastic. This is most frequently observed in bottling plants where carbonated beverages are placed into polyethylene terephthalate bottles. The stress placed upon the bottle by the bottling process and the internal pressure of the carbonated beverage contained within the bottle can cause stress cracks and fissures.

Various polyethylene terephthalate-compatible lubricant compositions have been developed by replacing at least a portion of the fatty acid with other lubricating components. For example, Rossio, U.S. Pat. No. 4,929,375 suggests that incorporation of a tertiary amine such as a ($C_{8-10}$) alkyl dimethyl amine into a fatty acid lubricant composition enhances the polyethylene terephthalate compatibility of the lubricant composition.

While these various attempts have been successful in producing lubricant compositions which are compatible with polyethylene terephthalate, such compositions have not generally been effective for providing both superior lubricity and superior compatibility with synthetic polymeric packaging materials.

Anderson et al., U.S. Pat. No. 4,521,321 teach conveyor track lubricant compositions employing a phosphate ester comprising an ethoxylated fatty alcohol phosphate ester in combination with a fatty amine oxide in an aqueous solution. The active ingredients are used at a concentration of about 100 to 200 ppm. Stanton et al., U.S. Pat. No. 4,604,220 teach an α-olefin based conveyor lubricant that can contain a minor amount of other ingredients including anionic phosphate esters. Scharf et al., U.S. Pat. No. 5,062,979 teach a soap-free conveyor lubricant comprising an alkoxy phosphate ester alkyl benzene sulfonate and a carboxylic acid. Rossio, U.S. Pat. No. 5,223,162 teaches a method for inhibiting stress cracking in a PET article which uses a hydrophilic substituted alkyl aryl anionic surfactant. One phosphate ester composition sold under the trademark TRITON®H-66 by Rohm and Haas Company is disclosed. Aepli et al., U.S. Pat. No. 3,860,521 disclose an aqueous lubricating concentrate for conveyor systems that comprises a fatty acid soap, a surfactant and a monostearyl phosphate. McDaniel, U.S. Pat. No. 5,001,114 teaches alkyl monoglycoside and polyglycoside phosphate esters and anionic derivatives thereof. Gutzmann, U.S. Pat. No. 5,352,376 teaches an aqueous lubricant composition containing an alkyl polyglycoside material in combination with organo phosphates including alkyl orthophosphate such as a stearyl (fatty alcohol) phosphate, an alkyl phosphate ester, etc. Despo, U.S. Pat. No. 5,391,308 teaches an alkaline aqueous lubricant concentrate containing a fatty acid, an alkyl phosphate ester and an alkyl aryl phosphate ester that operates both as an emulsifying agent and as a stress crack inhibitor.

A substantial need exists to develop active lubricant materials and methods that reduce or eliminate the presence of fatty acid ingredients, lower the pH of the lubricant solution, do not cause stress cracking in plastic, e.g. polyethylene terephthalate (P.E.T.) bottles and remains stable over a wide variation of pH. The common belief that alkalinity is a major cause of stress cracking has led to a customer preference for low alkalinity lubricants. In other instances the lubricant is not stable over a wide pH range. Consequently, the present invention solves a different combination of problems than the prior art compositions, allows use of the lubricant over a wide pH range, and prevents or inhibits stress cracking in P.E.T. containers.

SUMMARY OF THE INVENTION

The invention is directed to a method of lubricating conveyors with a use solution containing a lubricant which provides excellent lubricity but can be applied over a wide pH range and is compatible with glass, metal and plastic containers and beverages.

Accordingly, one aspect of the present invention includes a method of lubricating a conveyor system transporting beverage containers. The method includes diluting an aqueous conveyor lubricant concentrate with water and applying the diluted aqueous conveyor lubricant concentrate to the exterior or track of the containers being transported along a conveyor system. The lubricant includes a compound of the formula:

$$R^1—CONR^2—(EO)_n—PO_3M^1M^2 \quad (I)$$

where $R^1$ is a $C_{6-28}$ aliphatic group, $R^2$ is H, $(EO)_p$—H or $(EO)_m$—$PO_3M^1M^2$, in which EO is ethylene oxide, n, m and p are each independently 1 to about 50, and $M^1$ and $M^2$ are each independently selected from the group consisting of hydrogen, alkali metals and ammonium.

Another aspect of the invention includes a method of lubricating a conveyor system moving beverage containers by applying a use solution to the conveying system. The use solution includes, from about 5 ppm to 1000 ppm of a compound of the formula:

$$R^1—CONR^2—(EO)_n—PO_3M^1M^2 \quad (I)$$

where $R^1$, $R^2$, $M^1$ and $M^2$ are as defined above. The use solution also contains about 10 ppm to 1000 ppm of a surfactant, about 10 ppm to 1000 ppm of a chelating agent, about 10 ppm to 500 ppm of a sanitizing agent, and the balance water.

DETAILED DESCRIPTION OF THE INVENTION

The present invention provides a method of lubricating conveyors by diluting a lubricating concentrate to form a use solution containing a fatty amide ethoxylate phosphate ester and applying that use solution in the conveyor. The fatty amide ethoxylate phosphate ester may be present in the use solution from about 5 ppm to 1000 ppm. The use solution may be applied to the intended surface for lubrication.

Fatty Amide Ethoxylate Phosphate Ester

The lubricant of the present invention is a compound of the formula:

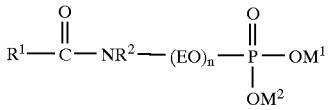

(I)

wherein $R^1$ is a $C_{6-28}$ aliphatic group derived from a corresponding fatty acid. This fatty acid may be either a straight or branched chain, saturated or unsaturated fatty acid or a mixture of saturated and unsaturated fatty acids. Examples include fatty acid moieties of caprylic acid, capric acid, lauric acid, myristic acid, palmitic acid, stearic acid isostearic acid, oleic acid, coconut oil fatty acid, palm oil fatty acid, palm nut oil fatty acid, cured beef tallow fatty acid and the like. Examples of fatty acids for this invention are tallow fatty acids and lauryl fatty acids. The preferred fatty acids have a carbon chain of ten to twenty carbon atoms.

$R^2$ is H, $(EO)_p$—H or $(EO)_m$—$PO_3M^1M^2$, EO is an ethylene oxide group, n, m and p could be individually 1 to 50, preferably 1 to 5 and $M^1$ and $M^2$ are each selected from the group consisting of hydrogen or an alkali metal, and/or ammonium, such as sodium, potassium, lithium, and ammonium. Preferred cations include hydrogen, sodium, potassium, and ammonium.

Such materials are suitably compatible in aqueous solution, provide a substantial reduction in interfacial friction, are compatible with common beverages, are pH insensitive, and are compatible with other common lubricant additive materials. The fatty amide ethoxylate phosphate ester (formula I) is stable for a wide range of pH, from about a pH of 3 to about a pH of 11 and preferably about pH 5 to pH 8. Such materials can be formulated into a lubricant concentrate material that can be diluted with an aqueous diluent to form a fully functional aqueous lubricant use composition. The ethoxylated fatty amide phosphate ester can be used to prepare an aqueous lubricant or lubricant concentrate, such concentrate can be diluted with water to form a lubricant and can be applied to a variety of interface surfaces requiring friction control i.e. conveyor systems, belts, moving glass, metal or plastic containers such as polyethylene terephthalate containers.

The ethoxylated fatty amide phosphate ester (formula I) is present in the lubricating concentrate. The amount may range from 0.5 wt-% to 90 wt-% of ethoxylated fatty amide phosphate ester (formula I) in the lubricating concentrate. In the use solution, the ethoxylated fatty amide phosphate ester (formula I) concentration generally ranges preferably from about 5 ppm to about 1000 ppm, and more preferably from about 50 ppm to about 200 ppm.

The fatty amide ethoxylate phosphate ester can be prepared by the following general procedure. The ethoxylate group of an ethoxylated fatty amide, as starting material, is reacted with a phosphorylation agent to obtain the fatty amide ethoxylate phosphate ester product (formula I). Neutralization can then be carried out with a basic agent.

The overall synthesis scheme is illustrated by way of example as follows:

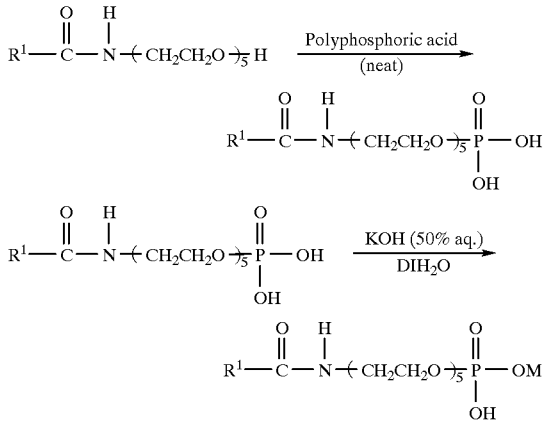

The ethoxylated fatty amides are readily available commercially. Examples of commercially available ethoxylated fatty amides are: Varamide T-55, a 5 mole ethoxylate of the monoethanol amide of tallow fatty acid (Witco Corp.); and Amidox L-5, a 5 mole ethoxylate of the monoethanol amide of lauryl fatty acid (Stepan Co.). Preferred fatty amide ethoxylate phosphate esters include those where the fatty acid portions fall in the $C_{10}$–$C_{20}$ range.

Several phosphorylating agents are readily available commercially. Examples of these phosphorylation agents include; polyphosphoric acid, phosphorous oxychloride, and phosphorous pentoxide. Preferred phosphorylation agents include polyphosphoric acid.

Neutralizing agents are readily available commercially. Examples of neutralizing agents include; sodium hydroxide, potassium hydroxide and lithium hydroxide. Preferred neutralizing agents are sodium hydroxide and potassium hydroxide.

Surfactant

The concentrate and use solution compositions of the invention optionally, but preferably, include a surfactant. The surfactant functions as an adjuvant to increase detergency and wetting. Compounds which may be used as surfactants in the invention include nonionic surfactants.

Nonionic surfactants are generally preferred. These are hydrophobic compounds which bear essentially no charge and exhibit a hydrophilic tendency due to the presence of oxygen in the molecule. Nonionic surfactants encompass a wide variety of polymeric compounds which include specifically, but not exclusively, ethoxylated alkylphenols, ethoxylated aliphatic alcohols, ethoxylated amines, ethoxylated ether amines, carboxylic esters, carboxylic amides, and polyoxyalkylene oxide block copolymers.

Particularly suitable nonionic surfactants for use in the lubricant composition of the invention are alkylated alcohol ethoxylates.

In the concentrate, the surfactant concentration is present in an amount up to about 30 %-wt and preferably from about 1%-wt to about 10%-wt. In the use solution, the surfactant concentration generally ranges from about 5 ppm to about 1000 ppm and preferably from about 10 ppm to about 100.

Sequestrants

In order to prevent the formation of precipitates or other salts, the concentrate and use solution compositions of the present invention may include a sequestrant.

Generally, sequestrants are those molecules capable of coordinating the metal ions commonly found in service water and thereby preventing the metal ions from interfering with the functioning of detersive components within the composition. The number of covalent bonds capable of being formed by a sequestrant upon a single hardness ion is reflected by labeling the sequestrant as bidentate (2), tridentate (3), tetradendate (4), etc. Any number of sequestrants may be used in accordance with the invention. Representative sequestrants include salts of amino carboxylic acids, phosphonic acid salts, water soluble acrylic polymers, among others.

Preferred amino carboxylic acid chelating agents include N-hydroxyethyliminodiacetic acid, nitrilotriacetic acid (NTA), ethylenediaminetetraacetic acid (EDTA), N-hydroxyethyl-ethylenediaminetriacetic acid (HEDTA), and diethylenetriaminepentaacetic acid (DTPA). When used, these amino carboxylic acids are present in the concentrate in an amount up to about 30 wt-% and preferably from about 2 wt-% to about 20 wt-%. These amino carboxylic acids are generally present in the use solution ranging from about 10 ppm to about 1000 ppm, preferably from about 20 ppm to about 200 ppm.

Other suitable sequestrants include water soluble acrylic polymers used to condition the wash solutions under end use conditions. Such polymers include polyacrylic acid, polymethacrylic acid, acrylic acid-methacrylic acid copolymers, hydrolyzed polyacrylamide, hydrolyzed methacrylamide, hydrolyzed acrylamide-methacrylamide copolymers, hydrolyzed polyacrylonitrile, hydrolyzed polymethacrylonitrile, hydrolyzed acrylonitrile methacrylonitrile copolymers, or mixtures thereof. Water soluble salts or partial salts of these polymers such as their respective alkali metal (for example, sodium or potassium) or ammonium salts can also be used.

The weight average molecular weight of the polyacrylic polymers is from about 4000 to about 12,000. Preferred polymers include polyacrylic acid, the partial sodium salts of polyacrylic acid or sodium polyacrylate having an average molecular weight within the range of 4000 to 8000. These acrylic polymers are generally useful in the use solution ranging from about 10 ppm to about 1000 ppm.

Also useful as sequestrants are phosphonic acids and phosphonic acid salts. Such useful phosphonic acids include, mono, di, tri and tetra-phosphonic acids which can also contain groups capable of forming anions under alkaline conditions such as carboxy, hydroxy, thio and the like. Among these are phosphonic acids having the formula $R_1N[CH_2PO_3H_2]_2$ or $R_2C(PO_3H_2)_2OH$, wherein $R_1$ may be -[(lower) alkylene]$N[CH_2PO_3H_2]_2$ or a third $(CH_2PO_3H_2)$ moiety; and wherein $R_2$ is selected from the group consisting of $C_{1-C6}$ alkyl.

The phosphonic acid may also comprise a low molecular weight phosphonopolycarboxylic acid such as one having about 2–4 carboxylic acid moieties and about 1–3 phosphonic acid groups. Such acids include 1-phosphono-1-methylsuccinic acid, phosphonosuccinic acid and 2-phosphonobutane-1,2,4-tricarboxylic acid.

When used as a sequestrant in the invention, phosphonic acids or salts are present in a use solution ranging from about 10 ppm to about 1000 ppm.

Sanitizing Agents

Generally, any solid or liquid chemical agent having microbicidal efficacy may be used in the composition of the present invention. Chemical compositions known to impart microbicidal efficacy include aldehydes, iodophors, phenolics, surfactants including anionic and cationic surfactants, and inorganic or organic chlorine releasing compounds and agents.

Representative compositions which could be used as antimicrobial agents in the invention include commonly available aldehydes such as formaldehyde and glutaraldehyde; iodophors such as iodine-nonionic surfactant complexes, iodine-polyvinyl pyrrolidone complexes, iodine-quatemary ammonium compounds and amphoteric iodine-amine oxide complexes and the like. Of primary interest as antimicrobials in the invention are cationic surfactants including quaternary ammonium compounds such as N-alkyl($C_{12-16}$) dimethylbenzyl ammonium chloride, N-didecyldimethyl ammonium chloride, N-tetradecyldimethylbenzyl ammonium chloride monohydrate, N-alkyl($C_{12-14}$) dimethyl 1-naphthylmethyl ammonium chloride and dodecyldimethylbenzyl ammonium chloride which is available commercially from manufacturers such as Stepan Chemical Company or Lonza, Inc.

When present, an antimicrobial agent must have a concentration effectively necessary for the required antimicrobial action to be provided. Generally, the concentration of antimicrobial agent may be present in the concentrate in an amount of up to 30 wt-%, preferably from about 2 wt-% to 20 wt-%. The concentration of antimicrobial agent in the use solution may range from about 10 ppm to about 500 ppm, preferably from about 20 ppm to 200 ppm.

Hydrotropes

Hydrotopes may also be present in the concentrate and use solutions. The hydrotope imparts physical stability to the formulation.

A variety of compatible hydrotropes are available for use in the lubricant composition including monofunctional and polyfunctional alcohols as well as glycol and glycol ether compounds. Those which have been found most useful include alkyl alcohols such as, for example, ethanol, isopropanol, and the like. Polyfunctional organic alcohols include glycerol, hexylene glycol, polyethylene glycol, propylene glycol, sorbitol and the like.

The preferred hydrotropes are di-functional alcohols such as alkyl glycols. One compound which has found heightened efficacy in stabilization of the use solution and its use solution is hexylene glycol. Other hydrotopes of interest include high HLB surfactants such as toluene sulfonates, xylene sulfonates, cumene sulfonates, octyl sulfonates and the simpler ethoxylated phosphate esters such as $C_{8-12}$ ethoxylated phosphate esters, especially the monophosphate ester of the 5 mole ethoxylate of decanol. When present, the concentration of the hydrotrope in the concentrate ranges up to about 20 wt-%. The concentration of the hydrotrope in the use solution ranges from about 10 ppm to about 1000 ppm.

Defoamer

The use solution compositions of the invention may also comprise a defoaming surfactant. A defoamer is a chemical compound with a hydrophobe-hydrophile balance suitable for reducing the stability of protein foam. The hydrophobicity can be provided by an oleophilic portion of the molecule. For example, an aromatic alkyl or alkyl group, an oxypropylene unit or oxypropylene chain, or other oxyalkylene functional groups other than oxyethylene provide this hydrophobic character. The hydrophilicity can be provided by oxyethylene units, chains, blocks and/or ester groups. For example, organophosphate esters, salt type groups or salt forming groups all provide hydrophilicity within a defoaming agent. Typically, defoamers are nonionic organic surface active polymers having hydrophobic groups, blocks or chains and hydrophilic ester groups, blocks, units or chains. However, anionic, cationic and amphoteric defoamers are also known.

Examples of defoaming agents suitable for use in the present compositions include silicone compounds such as silica dispersed in polydimethylsiloxane, fatty amides, hydrocarbon waxes, fatty acids, fatty esters, fatty alcohols, fatty acid soaps, ethoxylates, mineral oils, polyethylene glycol esters, polyoxyethylene- polyoxypropylene block copolymers, alkyl phosphate esters such as monostearyl phosphate, and the like. A discussion of defoaming agents may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated by reference herein.

Corrosion Inhibitor

The use solution compositions of the invention may also include a corrosion inhibitor. Useful corrosion inhibitors include polycarboxylic acids such as short chain carboxylic diacids, triacids, as well as phosphate esters and combinations thereof. Useful phosphate esters include alkyl phosphate esters, monoalkyl aryl phosphate esters, dialkyl aryl phosphate esters, trialkyl aryl phosphate esters, and mixtures thereof such as Emphos PS 236 commercially available from Witco Chemical Company.

Other useful corrosion inhibitors include the triazoles, such as benzotriazole, tolyltriazole and mercaptobenzothiazole, and in combinations with phosphonates such as 1-hydroxyethylidene-1,1-diphosphonic acid, and surfactants such as oleic acid diethanolamide and sodium cocoamphohydroxy propyl sulfonate, and the like.

The preferred corrosion inhibitors are polycarboxylic acids such as dicarboxylic acids. The acids which are preferred include adipic, glutaric, succinic, and mixtures thereof.

Concentrations

The concentration of the fatty amide ethoxylate phosphate ester may range from 0.5 %-wt to about 90%-wt in the concentrate. The concentration of the fatty amide ethoxylate phosphate ester may range from about 5 ppm to about 1000 ppm in the use solution. The other component concentrations of the present invention are illustrated in the table below.

| Component | Preferred Use Solution | Most Preferred Use Solution |
|---|---|---|
| fatty amide ethoxylate phosphate ester | 5–1000 ppm | 50–200 ppm |
| Surfactant | 5–1000 ppm | 10–100 ppm |
| Chelating Agent | 10–1000 ppm | 20–200 ppm |
| Sanitizing Agent | 10–500 ppm | 20–200 ppm |

| Component | Preferred Concentrate |
|---|---|
| fatty amide ethoxylate phosphate ester | 0.5–90 wt-% |
| Surfactant | up to 30 wt-% |
| Chelating Agent | up to 30 wt-% |
| Sanitizing Agent | up to 30 wt-% |

The exact dilution of the concentrate depends on factors such as water hardness, the speed of the conveyor track, the type of package or container being carried by the track, the total loading on the conveyor track and the amount of soiling caused by spillage.

Dilution of the lubricant concentrate is normally performed at a central dispenser, and the diluted lubricant composition is then pumped to spray nozzles at the point of use. There are some areas of the conveyor track that require very little lubricant. Typically these are zones before and after the filler and before the pasteurizer. In these regions, secondary dilution is often employed. Lubricant is likely to be at its highest use concentration at and after the filler.

The lubricant solutions are typically sprayed onto the conveyor from jet nozzles placed at the start of each section of track. For particularly long tracks, secondary spray jets may be positioned along the length of the track. The spraying can be continuous or time pulsed.

In areas of heavy soiling it may be necessary to spray lubricant onto the track continually. However, in most instances timers are employed to vary the dosing rate. Typically, on and off times will be between 10 and 90 seconds. Off times will not always equal on times. Also it is likely that throughout a plant, timer setting will vary.

In some applications, a final water jet will be placed at the end of a bottle/can filling track. This will wash residues of lubricant from the package before crating.

For a more complete understanding of the present invention reference is made to the following examples. The examples are intended to be illustrative and not limitative. The foregoing disclosure teaches to those of skill in the art the aspects of the invention including how to make and use the invention. The following examples are meant to provide further elucidation of the invention but are not meant as limitations thereof.

EXAMPLES

Application

Formulation and Use

Formulation

An illustrative fatty amide ethoxylate phosphate ester (PTMEAEO) was prepared by blending 14 grams (0.14 mole) of polyphosphoric acid (115% phosphoric acid titration) with 86 grams (0.12 mole) of Ethoxylated Tallow Monoethanol Amine (Witco Varamide T-55) at 170–200° F. and vigorously stirred. An additional 7.0 grams (0.07 mole) of polyphosphoric acid was blended into the melt for an additional 30 minutes at 170–200° F. The hardened melt was collected as product and treated as 100% phosphate ester.

Partial neutralization of the phosphate ester was accomplished by dissolving 2.5 grams of the crude phosphate ester in 22.5 ml of deionized water. The mixture was heated to 120° F. The warm acidic phosphate ester solution was then partially neutralized by the dropwise addition of a 50% KOH solution, the addition ceased when the pH reached 6.0.

PET Compatibility

Test Method: An amorphous PET strip (dog bone shaped with a center width of 0.5 inch and a thickness of 15 mil) is subjected to 5,000–8,000 psi of tension. Two test solutions are applied at two locations and time is allowed for the breakage to occur. The location at which failure (rupture) occurs indicates the more aggressive solution.

Number of Ruptures out of 5 tests

| | | | |
|---|---|---|---|
| Dicolube PL vs PTMEAEO: | 5 | to | 0 |
| PET STAR vs PTMEAEO: | 5 | to | 0 |
| Dicolube PL vs PET STAR: | 3 | to | 2 |

Note:
Dicolube PL is a conventional PET lube supplied by Diversey Lever Corp.
PET STAR is a conventional Ecolab lube
PTMEAEO is Fatty amide ethoxylate phosphate ester with (X,Y) = (16,5)
PTMEAEO is Fatty amide ethoxylate phosphate ester with (X,Y) = (16,5)
Data indicate PTMEAEO is less likely to cause PET stress cracking.

Compatibility with Beer and Beverage Products

Test procedure

1) Mix a 1% solution of product or raw material with an equal volume of a commercial beer/beverage product to be tested in a glass vial.

2) Observe visually formation of any precipitates or cloudiness.

A control sample, made of 1:1 mixture of water and a beer or beverage, was used for clarity comparison.

Result:

| Beer/Bev | Phosphorylate alkyl amide ethoxylate (X,Y) = (16,5) | Fatty acid based lube | Amine based lube | phosphate ester Rhodafac RA-600 |
|---|---|---|---|---|
| Beer | ND | Cloudy | Cloudy | Slightly cloudy |
| Coke | ND | Slightly cloudy | Cloudy | ND |
| Milk | ND | ND | ND | ND |
| Sprite | ND | Cloudy | ND | ND |
| Apple Juice | ND | Cloudy | Cloudy | ND |

ND: No detectable difference from the control sample

Lubricity

Lubricity test is carried out by measuring the drag force of a weighted test cylinder riding on a rotating stainless steel disc, wetted by a typically 0. 1% solution of test sample. Coefficient of Friction (COF) is then calculated by the ratio of the drag force to the total weight of the cylinder. To correct for change at contact surfaces due to testing, a reference lube is used to "standardized" the surface condition and a relative coefficient (Re1 COF) is calculated and used, where Re1 COF=COF (sample/COF (reference).

We use a fatty acid—based lubricant (Lubri-klenz LF or LK-LF) as reference. This is a conventional lube for glass and metal containers. A good lube would have a typical Re1 COF of less than 1.2, while a value greater than 1.4 would indicate a poor lubricant.

For the following tables, (X, Y) define the phosphate ester used in each test. They are:

$$CH_3(CH_2)_xC(=O)NH(CH_2CH_2O)_YPO_3M^1M^2$$

where (X, Y)=(10, 1), (10, 5) or, (16, 5) and $M^1$ and $M^2$ are selected from the group consisting of hydrogen and alkali metals.

Results:

TABLE 1

Effect of pH on Lubricity

| (X,Y) | pH | Lube Conc. (ppm) | Glass Relative COF | Steel Relative COF |
|---|---|---|---|---|
| 10,1 | 3.0 | 1000 | 1.07 | 0.99 |
| 10,1 | 4.0 | 1000 | 1.04 | 1.04 |
| 10,1 | 5.0 | 1000 | 1.03 | 1.09 |
| 10,1 | 6.0 | 1000 | 1.02 | 1.20 |
| 16,5 | 3.0 | 1000 | 0.94 | 1.15 |
| 16,5 | 4.0 | 1000 | 1.06 | 1.17 |
| 16,5 | 5.8 | 1000 | 0.99 | 1.11 |
| 16,5 | 7.0 | 1000 | 1.01 | 1.20 |
| 16,5 | 8.0 | 1000 | 1.02 | 1.10 |
| 16,5 | 9.0 | 1000 | 1.02 | 1.10 |
| 16,5 | 10.0 | 1000 | 1.03 | 1.08 |

Table 1 summarizes the lubricity data for phosphorylated Tallow MEA ethoxylate. Re1 COF's in the range of 0.95 to 1.02 were demonstrated for glass on stainless steel over a pH range of 3–7. Lubrication effect is also observed for metal surfaces of mild steel on stainless steel with Re1 COF of 1.05 to 1.25 over the pH range of 3–7. These values are to be compared with a value of 2–3 for water and about 0.9–1.05 for a typical fatty acid lube.

Without the introduction of the phosphate ester group, Varamide T55 has a Re1 COF of about 2.0 for glass or metal surfaces.

TABLE 2

Effect of Lube Concentration on Lubricity

| (X,Y) | pH | Lube Conc. (ppm) | Glass Relative COF | Steel Relative COF |
|---|---|---|---|---|
| 16,5 | 6.0 | 5000 | 0.90 | 1.25 |
| 16,5 | 6.0 | 2500 | 0.98 | 1.21 |
| 16,5 | 6.0 | 1000 | 0.94 | 1.16 |
| 16,5 | 6.0 | 500 | 1.07 | 1.15 |
| 16,5 | 6.0 | 100 | 0.92 | 1.17 |
| 16,5 | 6.0 | 50 | 1.04 | 1.20 |

TABLE 3

Effect of Alkyldimethylbenzylammonium Chloride (Sanitizer) on Lubricity

| (X,Y) | pH | Lube Conc. (ppm) | Q-375 (ppm) | Glass Relative COF | Steel Relative COF |
|---|---|---|---|---|---|
| 16,5 | 6.5 | 1000 | 0 | 0.91 | 1.02 |
| 16,5 | 6.5 | 1000 | 50 | 0.94 | 1.10 |
| 16,5 | 6.5 | 1000 | 100 | 1.00 | 1.12 |
| 16,5 | 6.5 | 1000 | 200 | 1.07 | 1.15 |
| 16,5 | 6.5 | 1000 | 500 | 1.07 | 1.22 |

Lubricity of formulations using the fatty amide ethoxylate phosphate ester compared to typical fatty acid lube

| Components of Invention lube (PTMEAEO) | Component Conc. (wt %) | pH = 3.90 |
|---|---|---|
| $C_{10}$–$C_{14}$ dimethyl benzyl ammonium chloride | 5.00 | |
| Ethylene diamine tetraacetic acid (tetra sodium salt) | 5.00 | |
| Octadecyl amidoethoxylate phosphate ester | 6.25 | |
| Plurafac LF 131 (BASF Corp.) | 2.50 | |
| Water | 81.25 | |

| Components of Reference lube (LK-LF) | Trade name | Component Conc. (wt %) | pH = 8.72 |
|---|---|---|---|
| Tall oil fatty acid | Tall Oil FA | 10.0 | |
| Nonyl phenol ethoxylate (9.5) | NPE 9.5 | 8.0 | |
| Sodium xylene sulfonate (40%) | SXS (45%) | 4.0 | |
| Hexylene glycol | Hexylene glycol | 2.0 | |
| Triethanol amine | TEA | 13.5 | |
| Ethylene diamine tetraacetic acid (tetra sodium salt) | EDTA | 10.0 | |
| Formaldehyde | Formalin (37%) | 0.24 | |
| Water | | 52.26 | |

Evaluation of lube formulas

Glass/Stainless Steel

| Sample | Lube Conc. (wt %) | Lube pH | Run order | Rel COF |
|---|---|---|---|---|
| Ref LK-LF | 0.50 | 8.80 | 1 | 1.00 |
| PTMEAEO | 0.50 | 6.90 | 2 | 0.90 |
| RefLK-LF | 0.50 | 8.80 | 3 | 1.00 |

Mild Steel/Stainless Steel

| Sample | Lube Conc. (wt %) | Lube pH | Run order | Rel COF |
|---|---|---|---|---|
| Ref LK-LF | 0.50 | 8.80 | 1 | 1.00 |
| PTMEAEO | 0.50 | 6.90 | 2 | 0.98 |
| Ref LK-LF | 0.50 | 8.80 | 3 | 1.00 |

Plastic (PET)/Stainless Steel Lube

| Sample | Conc. (wt% ) | Lube pH | Run order | Rel COF |
|---|---|---|---|---|
| Ref LK-LF | 0.10 | 8.72 | 1 | 1.00 |
| PTMEAEO | 0.10 | 7.56 | 2 | 0.95 |
| Ref LK-LF | 0.10 | 8.72 | 3 | 1.00 |

Nomenclature
Dicolube PL = Commercial product from Diversey, fatty acid lubricant.
PET STAR = Ecolab - fatty acid lubricant.
Lubri-klenz LF = Ecolab - fatty acid lubricant.
Lubri-klenz S = Ecolab - fatty amine lubricant.
Rhodafac RA-600 = Decanol penta oxyethylene phosphate - Rhone-Poulenc
Varamide T55 = Tallow monoethanol amide penta oxyethylene - Witco Corp.
Q-372 = $C_{12}$–$C_{14}$ dimethyl benzyl ammonium chloride - Ecolab
PTMEAEO = Tallow monoethanol amide penta oxyethylene phosphate The above data demonstrate that the lubricants of the present invention are as good as or superior to conventional lubricants at a lower pH for glass, metal and plastic (PET) containers.

We claim:

1. A method of lubricating a conveyor system transporting beverage containers comprising:

diluting an aqueous conveyor lubricant concentrate with water; and applying the diluted aqueous conveyor lubricant to the exterior of said containers being transported along a conveyor system wherein the concentrate comprises a compound of the formula:

$$R^1—(CONR^2—(EO)_n—PO_3M^1M^2$$

wherein $R^1$ is a $C_{6-28}$ aliphatic group, $R^2$ is H, $(EO)_p$—H or $(EO)_m$—$PO_3M^1M^2$ in which EO is ethylene oxide and n, m and p are each individually 1 to about 50, and $M^1$ and $M^2$ are each independently selected from the group consisting of hydrogen, an alkali metal and ammonium.

2. The method of claim 1, wherein the amount of the compound in the conveyor lubricant concentrate is from about 0.5 wt-% to about 90 wt-%.

3. The method of claim 1, wherein the concentrate has a pH of about 3 to 11 .

4. The method of claim 1, wherein the concentrate additionally comprises a surfactant.

5. The method of claim 4, wherein the surfactant comprises a nonionic surfactant.

6. The method of claim 1, wherein the concentrate further comprises a chelating agent.

7. The method of claim 1, wherein the concentrate additionally comprises a sanitizing agent.

8. The method of claim 1, wherein the containers are glass, metal or plastic.

9. The method of claim 8, wherein the plastic containers are polyethylene terephthalate.

10. A method of lubricating a conveyor system transporting beverage containers comprising applying to said system a use solution comprising:

(a) from about 5 ppm to 1000 ppm of a compound of the formula:

$$R^1—CONR^2—(EO)_n—PO_3M^1M^2$$

wherein $R^1$ is a $C_{6-28}$ aliphatic group, $R^2$ is H, $(EO)_p$—H or $(EO)_m$—$PO_3M^1M^2$ in which EO is ethylene oxide and n, m and p are each individually about 1 to 50, $M^1$ and $M^2$ are each independently selected from the group consisting of hydrogen, an alkali metal and ammonium;

(b) from about 5 ppm to 1000 ppm of a surfactant;

(c) from about 10 ppm to 1000 ppm of a chelating agent;

(d) from about 10 ppm to 500 ppm of a sanitizing agent; and (e) the balance water.

11. The method of claim 10, wherein the use solution has a pH of about 3–11.

12. The method of claim 10, wherein the surfactant comprises a nonionic surfactant.

13. The method of claim 12, wherein the nonionic surfactant is an alkylated alcohol ethoxylate.

14. The method of claim 10, wherein the chelating agent is ethylene diamine tetraacetic acid or a salt thereof.

15. The method of claim 10, wherein the sanitizing agent is a quaternary ammonium compound.

16. The method of claim 15, wherein the quaternary ammonium compound is an N-alkyldimethylbenzyl ammonium chloride, in which alkyl is $C_{12}$ to $C_{16}$, and mixtures thereof.

17. The method of claim 15, wherein the quaternary ammonium compound is N-didecyldimethyl ammonium chloride.

18. A method of lubricating a conveyor system transporting beverage containers comprising applying to said system a use solution comprising:

(a) from about 50 ppm to 200 ppm of a compound of the formula:

$$R^1—CONR^2—(EO)_n—PO_3M^1M^2$$

wherein $R^1$ is a $C_{10-20}$ aliphatic group, $R^2$ is H, $(EO)_p$—H or $(EO)_m$—$PO_3M^1M^2$ in which EO is ethylene oxide and n, m and p are each individually about 1 to 5, $M^1$ and $M^2$ are each independently selected from the group consisting of hydrogen, an alkali metal and ammonium;

(b) from about 10 ppm to 100 ppm of a nonionic surfactant;

(c) from about 20 ppm to 200 ppm of ethylene diamine tetraacetic acid tetrasodium salt;

(d) from about 20 ppm to 200 ppm of a $C_{12}$–$C_{16}$ dimethylbenzyl ammonium chloride; and e) the balance water.

19. The method of claim 18, wherein the use solution has a pH of about 5 to about 8.

* * * * *